US008826931B2

(12) United States Patent
Clark et al.

(10) Patent No.: US 8,826,931 B2
(45) Date of Patent: Sep. 9, 2014

(54) WATER ACTUATED PRESSURIZED GAS RELEASE DEVICE

(75) Inventors: Robert E. Clark, Seminole, FL (US); Brian Ford, Seminole, FL (US); Michael E. Kelley, Seminole, FL (US); Christopher Motta, St. Petersburg, FL (US); Alphonse S. Larose, Tampa, FL (US)

(73) Assignee: Carleton Technologies, Inc., Orchard Park, NY (US)

( * ) Notice: Subject to any disclaimer, the term of this patent is extended or adjusted under 35 U.S.C. 154(b) by 494 days.

(21) Appl. No.: 13/231,682

(22) Filed: Sep. 13, 2011

(65) Prior Publication Data

US 2012/0073677 A1 Mar. 29, 2012

Related U.S. Application Data

(60) Provisional application No. 61/382,271, filed on Sep. 13, 2010.

(51) Int. Cl.
*B63C 9/19* (2006.01)
*B63C 9/00* (2006.01)

(52) U.S. Cl.
CPC ..... *B63C 9/19* (2013.01); *B63C 2009/007* (2013.01); *B63C 2009/0047* (2013.01)
USPC ..... 137/81.2; 285/277; 285/282; 361/251; 441/93; 441/94; 441/96

(58) Field of Classification Search
CPC ..... B63C 9/24; B63C 9/18; B63C 9/19; B63C 2009/0064; F16K 31/524; F17C 7/00
USPC ..... 137/81.2; 441/88, 92, 93, 94, 96; 361/251; 285/276, 277, 282
See application file for complete search history.

(56) References Cited

U.S. PATENT DOCUMENTS

| | | | | |
|---|---|---|---|---|
| 4,024,440 | A | 5/1977 | Miller | |
| 4,413,805 | A | 11/1983 | Green et al. | |
| 4,482,333 | A | 11/1984 | Geri et al. | |
| 4,768,128 | A | 8/1988 | Jankowiak et al. | |
| 5,148,346 | A | 9/1992 | Naab et al. | |
| 5,640,997 | A | 6/1997 | Reed et al. | |
| 7,118,437 | B1 | 10/2006 | Bradley et al. | |
| 7,444,891 | B1 | 11/2008 | Chadwick et al. | |
| 8,721,379 | B2 * | 5/2014 | Becnel | 441/93 |

* cited by examiner

*Primary Examiner* — Craig Schneider
(74) *Attorney, Agent, or Firm* — Jaeckle Fleischmann and Mugel, LLP

(57) ABSTRACT

Disclosed is a gas release device that is adapted to be secured to an inflatable article. The device includes an container, which can be a commercially available gas bottle, a salinity sensor, and an end cap. The salinity sensor operates an electrically fireable primer that serves to release an inflation gas from the container and inflate the article. The end cap includes a cylindrical through hole that accepts a rotatable D-ring. The D-ring is dimensioned to fit over the valve of the inflatable article. The D-ring includes a series of peripheral apertures that can be selectively aligned with a slot to create a fluid passage between the container and valve. The D-ring allows the device to be rotated between different angular positions while maintaining a pneumatic coupling between to the inflatable article and the container.

15 Claims, 6 Drawing Sheets

WATER ACTUATED PRESSURIZED GAS RELEASE DEVICE

CROSS-REFERENCE TO RELATED APPLICATIONS

This application claims priority to, and is a continuation of provisional application Ser. No. 61/382,271 filed on Sep. 13, 2010 and entitled "Water Actuated Pressurized Gas Release Device." The contents of this application are fully incorporated herein for all purposes.

BACKGROUND OF THE INVENTION

1. Field of the Invention

This invention relates to a gas release device. More particularly, the present invention relates to a gas release device that is activated by both fresh and salt water and that can be adjustably mounted upon flotation equipment.

2. Description of the Background Art

The use of pressurized gas release devices for inflating floatation equipment is known in the art. For example, U.S. Pat. No. 4,024,440 to Miller and U.S. Pat. No. 4,768,128 to Jankowiak et al, which are assigned to the assignee of the present invention and are incorporated herein by reference, describe water-actuated, pressurized gas release devices for inflating flotation equipment, such as life vests that are adapted for use by pilots and seamen.

These devices work well because they are easily worn by a pilot or by a seaman working around water. This ensures that the device will be available should the pilot ever be forced to abandon his aircraft or should the seaman ever fall overboard from a ship. Then, the device will automatically actuate to inflate a flotation device and help save the pilot's or seaman's life. There are other floatation devices in the marketplace that also accept gas pressurized inflating devices, such as rafts. However many of the currently used flotation devices are designed with an interface that is specifically designed to accept only one type of gas pressurized inflation devices.

Similarly, U.S. Pat. No. 5,148,346, issued Sep. 15, 1992 to Naab et al., and also subject to assignment to the current assignee and incorporated herein by reference, describes an electromagnetic interference (or "EMI") protected, water-actuated pressurized gas release device. The EMI protected, water-actuated pressurized gas release device is constructed with a skirt or step that overlaps the interface between the circuit casing and the associated primer casing. The step serves to block the interface between the casings to reduce the possibility of EMI radiation passing along the interface to the electric circuitry. The passage between the battery bore and the electronics cavity is also provided with an EMI filter that is electrically connected between the electronic lead wire and the circuit casing with at least one capacitor to shunt EMI radiation leaking into the circuit casing to ground. These improvements provide the device with a high level of EMI protection in accordance with current government standards.

The above referenced devices all work well for their intended purposes. However, there is a need for a low cost, lightweight, unobtrusive water-actuated pressurized gas release device for general commercial, military and/or individual recreational use which interfaces with a variety of flotation devices, vests, rafts, etc. The device needs to automatically inflate an associated personal flotation device should the person ever be subjected to a potentially life-threatening drowning situation, and the device must provide a manual means of being activated as a backup inflation method should the device fail to automatically inflate or if the user wishes to manually inflate the flotation device before entering the water. It also needs to be easy to wear and unobtrusive and fit a variety of interfaces. This ensures that the pressurized gas release device will be worn at all times and therefore available should the person ever become submerged in fresh or salt water. In addition, the device needs to be reliable but inexpensive to manufacture so that it can be sold as a low-cost, non-reusable water-actuated pressurized gas release device.

The water-actuated, pressurized gas release device of the present invention fits all standard inflatable life vests, life jackets, and life rafts, with a variety of interface means, and can be adapted to connect to conventional pressurized gas cartridges or containers. This makes the device particularly useful to people working on off-shore drilling rigs, on work boats, and in shipyards, as well as to people engaged in construction activities around water, commercial fishing, recreational boating and racing activities and even children, handicapped people or elderly people engaged in activities on or near water. Furthermore, the pressurized gas release device can be manually actuated by a lever connected to the device. Once the device is automatically actuated the piercing pin locks forward. This prevents the device from being re-used because if a new cylinder is screwed into the body the locked forward piecing pin will puncture the cylinder as it is being it tightened. In addition, the device has a firing indicator pin that is visible through the end cap. The firing pin is only actuated after device is automatically triggered.

SUMMARY OF THE INVENTION

An advantage of the present device is that it can be easily fitted to any standard inflatable life vests, life jackets, or life rafts.

Another advantage of the present device is that it can be connected to a variety of conventional pressurized gas cartridges or containers with different interfaces.

Yet another advantage of the present device is that it can be connected to the standard pressurized gas cartridges that are typically used for automotive airbags.

Still yet another advantage of the present invention is that it can be connected to inflation equipment via a rotatable ring, whereby the device can be connected in any of a variety of orientations, which adds both to the ease, convenience and acceptability of use as well as broadly useful with many different interfaces.

A further advantage of the present invention is that it can be fitted to a salinity sensor whereby the gas cartridge can be activated in the presence of fresh or salt water.

These and other advantages are provided by a device suitable for general commercial and individual recreational use that is automatically actuated to release gas from a pressurized gas cylinder when immersed in an electrically conductive fluid. In particular, the pressurized gas release device of the present invention has a relatively small size and is of a lightweight construction that does not hinder a person moving about. That way, the device can be worn on a belt or otherwise secured to a person's body as a personal effect and serves to automatically inflate a personal flotation device should the person inadvertently fall into fresh or salt water. The personal flotation device can be a life jacket, a life vest or a personal life raft. The potentially life-threatening drowning situation is thereby averted.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

The present invention relates to a gas release device that is adapted to be secured to an inflatable article. The device includes an container, which can be a commercially available gas bottle, a salinity sensor, and an end cap. The salinity sensor operates an electrically fireable primer that serves to release an inflation gas from the container and inflate the article. The end cap includes a cylindrical through hole that accepts a rotatable D-ring. The D-ring is dimensioned to fit over the valve of the inflatable article. The D-ring includes a series of peripheral apertures that can be selectively aligned with a slot to create a fluid passage between the container and valve. The D-ring allows the device to be rotated between different angular positions while maintaining a pneumatic coupling between to the inflatable article and the container. In an alternative embodiment, the D-ring is replaced by a D-shaped keyway.

Gas Release Device

Figure 1:
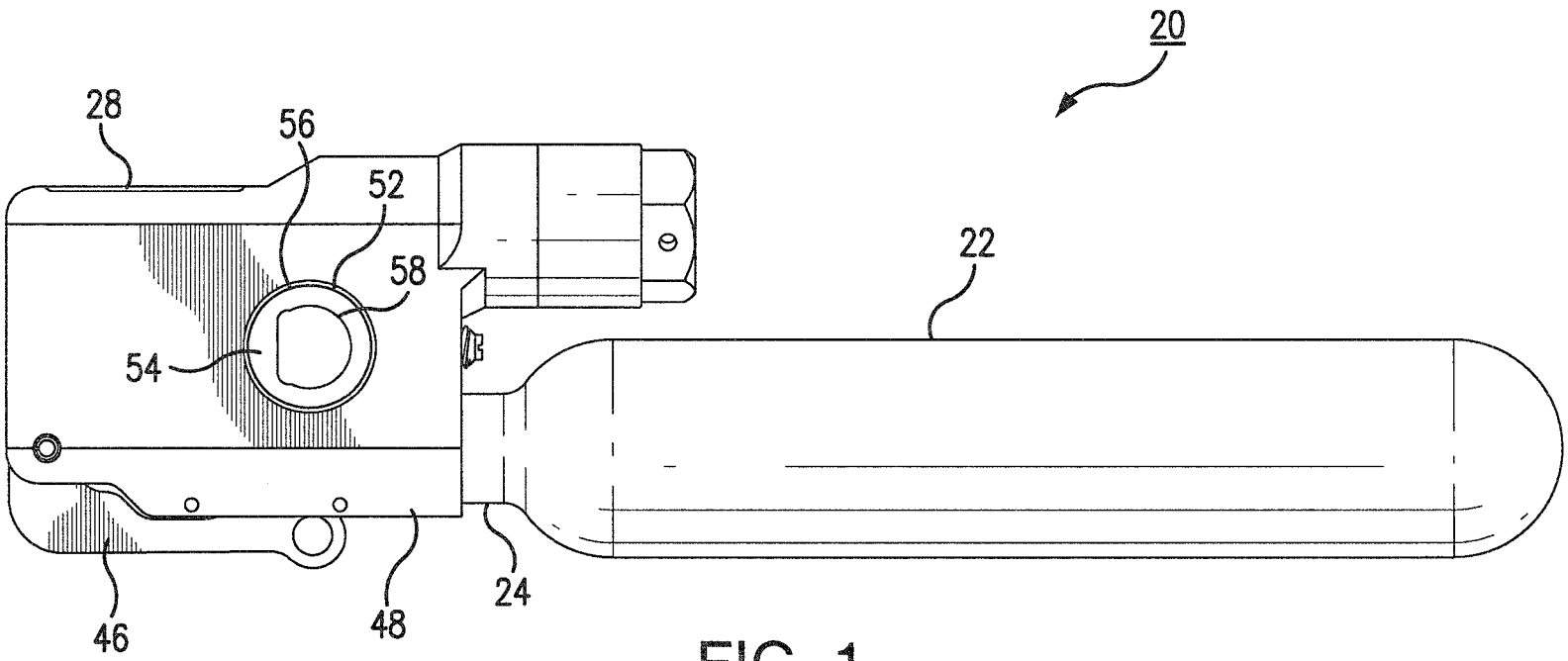
FIG. 1 is a side elevational view of a an inflation device employing a D-ring insert.
Figure 2:
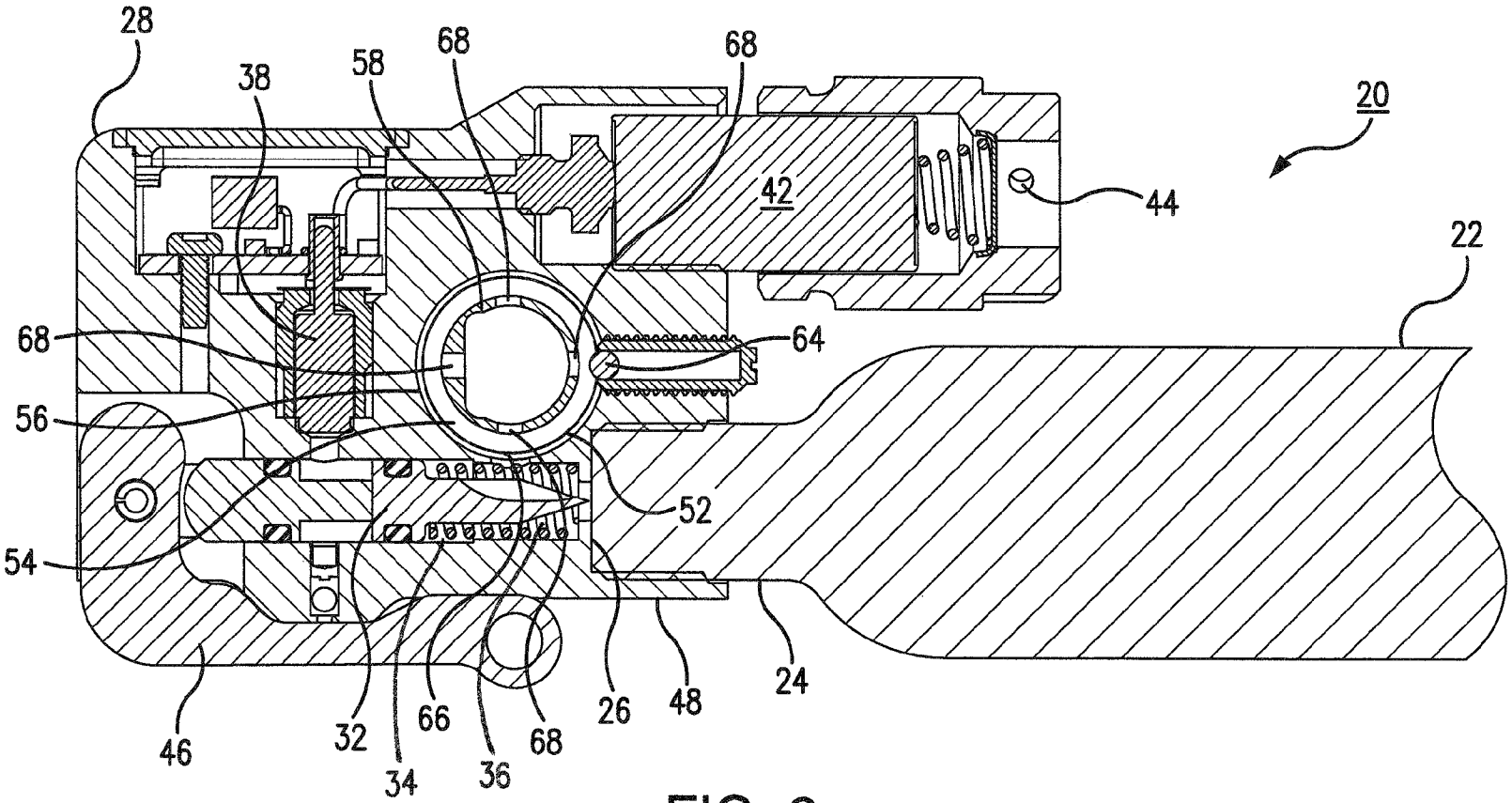
FIG. 2 is a cross-sectional view of the inflation device of FIG. 1.

FIGS. 1-2 illustrate the gas release device 20 and associated container 22. Container 22, which can be a conventional $CO_2$ cylinder, includes a forward end 24 and an interior for storing an inflation gas under pressure. The inflation gas can be a mixture of pressurized helium and argon gas. The use of other inflation gases is known. A diaphragm 26 is mounted to the forward end 24 of container in a fluid tight manner (note FIG. 2). Diaphragm 26 prevents the inflation gas from escaping the container prior to activation.

End cap 28 houses a puncture pin 32 that is employed in rupturing diaphragm 26. Puncture pin 32 is positioned within a passage 34 and is surrounded by a spring 36 that initially keeps pin 32 from contacting diaphragm 26. There are two O-rings on the pin 32 that isolate the combustion gas from the inflation gas. This feature is more fully described in U.S. Pat. No. 4,024,440 to Miller. Pin 32 can be urged forwardly against the spring bias either automatically or manually. Automatic actuation is carried out by way of a primer, battery, and a sensor. (38, 42, and 44) When sensor 44 detects sea water, a circuit is completed with battery 42 to fire primer 38. This, in turn, forces the puncture pin 32 to rupture diaphragm 26 and permit the flow of the inflation gas. Alternatively, a cam lever 46 can be manually pivoted by the user to force puncture pin 32 to rupture diaphragm 26. In either case, the inflation gas escapes from container to inflate the attached article. U.S. Pat. No. 4,024,440 to Miller, which is fully incorporated herein, more describes the automatic and manual methods of inflation employed by the present device.

Since the inflation device 20 will be present near sources of intense EMI, such as radar antennas, it is also necessary to protect the sensor from the EMI to prevent damage to the electronics or accidental activation of the inflation device. As a result, the housing may be made from a number of EMI absorbing metallic materials, it may contain an EMI absorbing foil(s), or it may be made from an injection molded plastic containing EMI absorbing materials. A suitable EMI shielding is described in U.S. Pat. No. 5,148,346 to Naab et al, the disclosure of which is fully incorporated herein.

End Cap and D-Ring

End cap 28 is positioned over forward end 24 of container 22 and includes a lower peripheral skirt 48 that extends down over the upper end 24 of container 22. Skirt 48 can be fitted onto the forward end 24 of container 22 via a threaded connection or by crimping. Ideally, the fitting between skirt 48 and container 22 is air tight so as not to permit the passage of the inflation gas.

End cap 28 includes a cylindrical through hole opening 52 that rotatably receives a D-ring insert 54. D-ring 54 insert permits device 20 to be fitted onto the valve stem of an inflation article. D-ring includes a generally cylindrical outer surface 56. Peripheral grooves are formed upon outer surface 56 and are adapted to receive one or more O-rings. O-rings form a pneumatic seal between D-ring 54 and cylindrical opening 52. The inner opening 58 of D-ring 54 is "D" shaped. This allows D-ring 54 to be fitted over the D-shaped valve stem of a standard Schrader valve (not shown). The inner opening 58 can employ other dimensions and/or shapes to accommodate other types of valve stems.

In accordance with the invention, D-ring 54 is rotatably positioned within cylindrical opening 52. Means are included for locking D-ring 54 at different angular orientations with respect to device 20. In the embodiment depicted in FIGS. 1-2, the means comprises a spring biased detent 64 to position D-ring 54 in one of four angular orientations. Detent 64 is comprised of a spring biased ball bearing that fits into corresponding recesses within D-ring 54. In the depicted embodiment, D-ring 54 is restrained at the angular positions corresponding to 0°, 90°, 180°, and 270° These angular positions correspond to four ports 68 positioned through the side of D-ring 54. Other detent means can likewise be employed. For instance, tab can be positioned about the periphery of D-ring that can be fitted into corresponding recesses within the cylindrical opening.

By rotating D-ring 56 within opening 52, the device 20 can be secured to the inflatable article in one of three different orientations. These orientations generally correspond with an upward, a downward, and a sideward orientations of device 20. However, any number of orientations can be employed according to the needs of a particular inflation device. End cap includes an internal slot 66 that extends between the cylindrical opening 52 and the pierce pin passage 34. Ports 68 within D-ring 54 are brought into registry with slot 66 at each of the locked angular positions: 0°, 90°, 180°, and 270°. Thus, whenever D-ring 54 is locked into one of these orientations, a fluid channel is created that extends between diaphragm 26 and the valve stem.

The rotating D-ring 54 can be positioned to fit the LPU 9, LPU-23, LPU-21, MK1 Flight Deck, LPU-36, and LPU-38, and all other military life preservers that have the standard Schrader valve. During actuation the inflation pressure is retained by o-rings about the periphery of the D-ring.

Device Operation

In operation, device is fitted onto the Schrader valve on the inflation article. Device 20 is then rotated about D-ring 54 to a desired orientation. As device 20 is rotated, D-ring 54 remains secured over the Schrader valve 62. Device can then be locked at one of the four angular orientations 0°, 90°, 180°, or 270°. At each of these orientations, a port 68 within D-ring is aligned with the internal slot 66 to create a fluid path "F." Path "F" extends from container 22, through diaphragm 26, through the pierce pin passage 34, through slot 66, through port 68, through the valve stem 62, and into the article to be inflated. This fluid path "F" permits the inflation fluid to inflate the article once diaphragm 26 is broken. In the preferred embodiment, the connection between valve stem 62 and D-ring 54 is fluid tight. In addition, a gasket is provided on either side of the D-ring 54 to prevent blow by of the inflation gas.

Thereafter, if the crewmember comes into contact with seawater sensor completes a circuit to allow the battery 42 to charge up. The circuit then sends a pulse of energy to trigger primer 28. This, in turn, urges pierce or puncture pin 32 forwardly to rupture diaphragm 26 to create fluid path "F" and inflate the article.

Alternatively, the crewmember can manually inflate the article. To manually operate, a lanyard is pulled which rotates the cam lever 46. As the cam lever 46 rotates contact with the driver creates a force that moves the pierce pin 32 forward. Again, this ruptures diaphragm 26 to create fluid path "F" and inflate the article.

Alternative Embodiments

Figure 3:
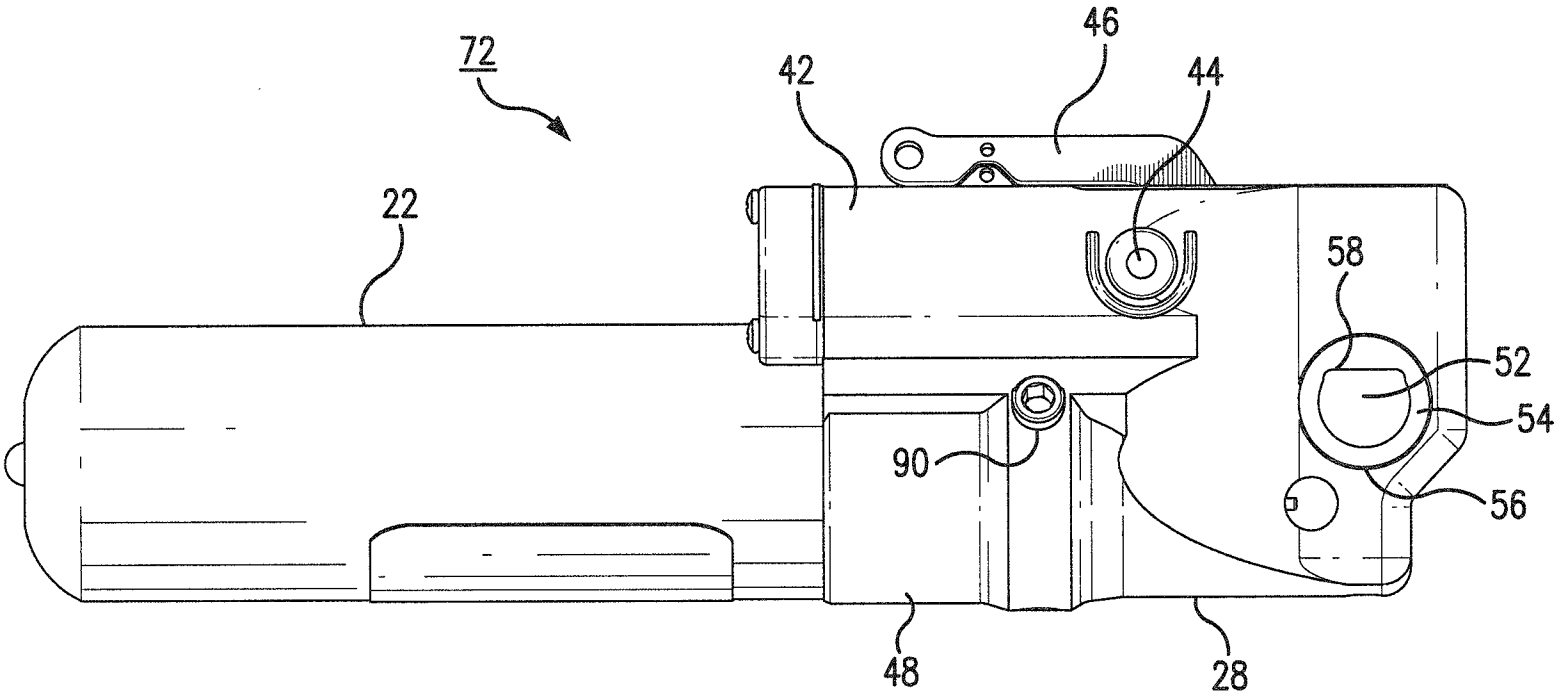
FIG. 3 is an alternative embodiment of an inflation device employing a D-ring insert.
Figure 4:
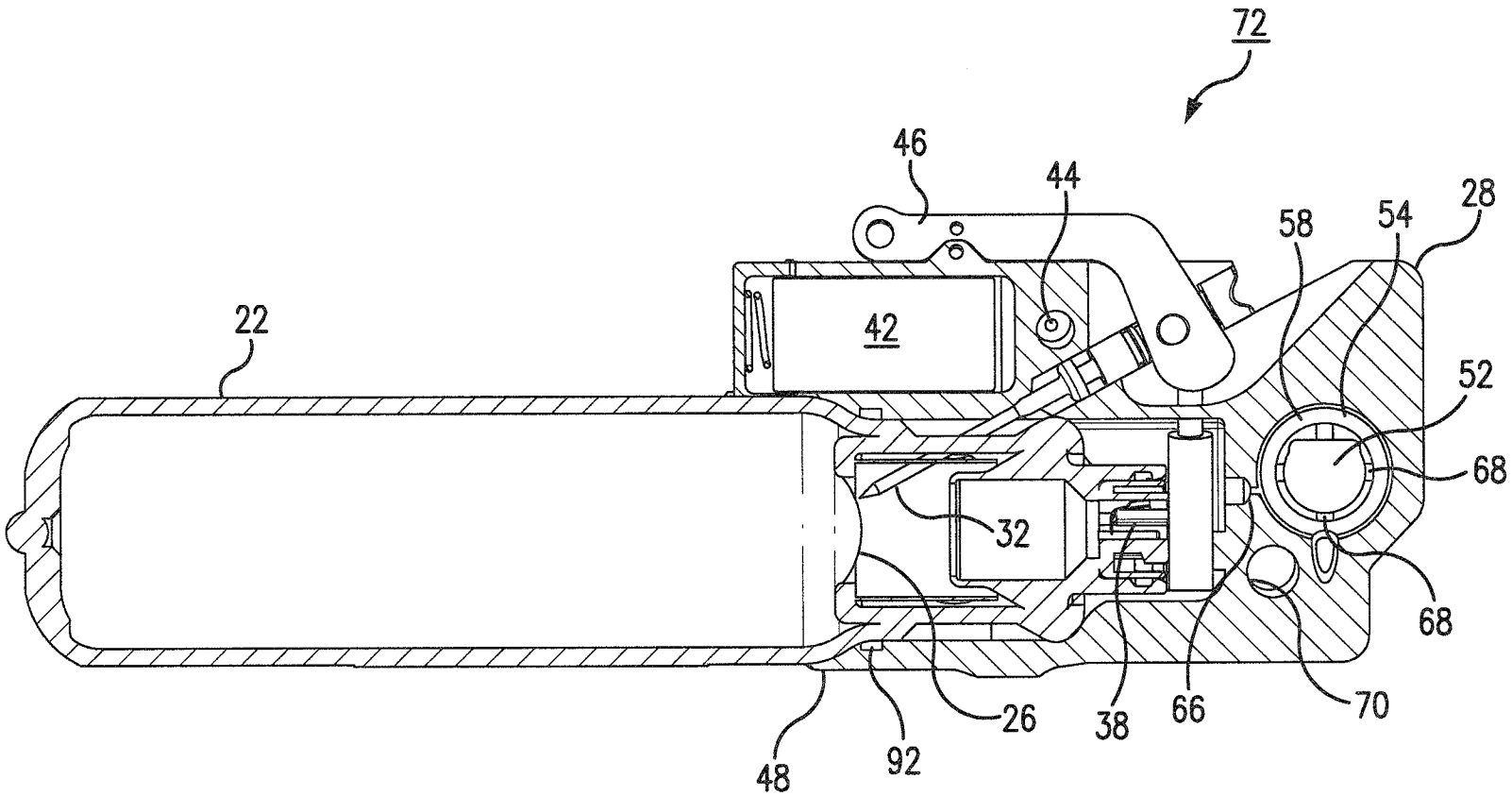
FIG. 4 is a cross-sectional view of the alternative embodiment of FIG. 3.

Various alternative embodiments of the present invention are illustrated in FIGS. 3-6. FIGS. 3-4 illustrate and embodiment 72 with a D-ring and end cap (54 and 28) as described above, but used with a conventional air bag gas generator. The D-Ring 54 of FIG. 4 operates the same as the D-ring 54 described above. A set screw 90 is included for retaining end cap 28. Additionally, as noted in FIG. 4, an O-ring 92 seals end cap over container 22. A firing indicator 70 is also included. This embodiment can also be used with conventional air bag generators, such as the type used to deploy automotive air bags. For example, this embodiment is preferably used with CGI-130 model inflator from Key Safety Systems of Sterling Heights, Mich. Other acceptable gas generators include the commercially available ACH-2.0b model Inflator made by Autoliv ASP, Inc. of Odgen, Utah. Another suitable inflator is described in U.S. Pat. No. 5,979,936, which is assigned to Autoliv ASP, Inc.

To manually actuate inflator 72, cam lever 46 is pivoted, whereby piecing pin 32 penetrates diaphragm 26. Thereafter, gas exits through slot passage 66. Slot 66 has the benefit of slowing the flow and cooling the gas. Thereafter, the gas passes through the aligned D-ring port 68 and into the Schrader valve stem 62. Note there is no spring to hold back piercing pin. But there is a step in the bore that holds the o-ring on the piercing pin to resist any premature downward movement.

The automatic actuation of inflator 72 is next described. Once device 72 is immersed in water, sensor 44 is triggered. This, in turn, closes a circuit, whereby 12 v batteries charge up a capacitor in the circuit. The voltage discharges through a connector to a primer or initiator 38. Once initiator 38 fires, combustion gas funnels down to rupture diaphragm 26. This releases helium/argon gas from the container 22. This gas exits into end cap (or manifold), exits through orifice or passage 66 in end cap. The gas then passes through an aligned port 68 in D-ring 54, and into Schrader valve 62.

Figure 5:
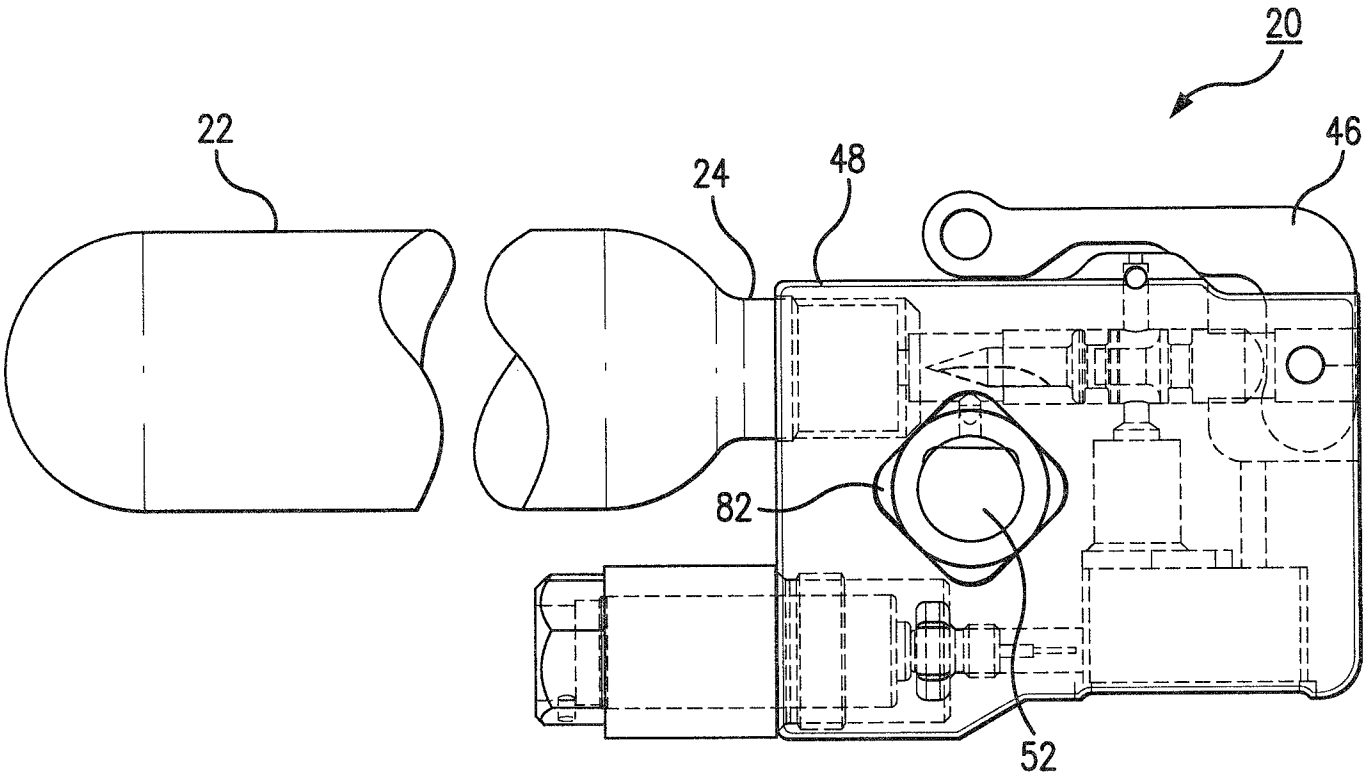
FIG. 5 is a perspective view of an alternative embodiment employing a D-shaped keyway assembly.
Figure 6:
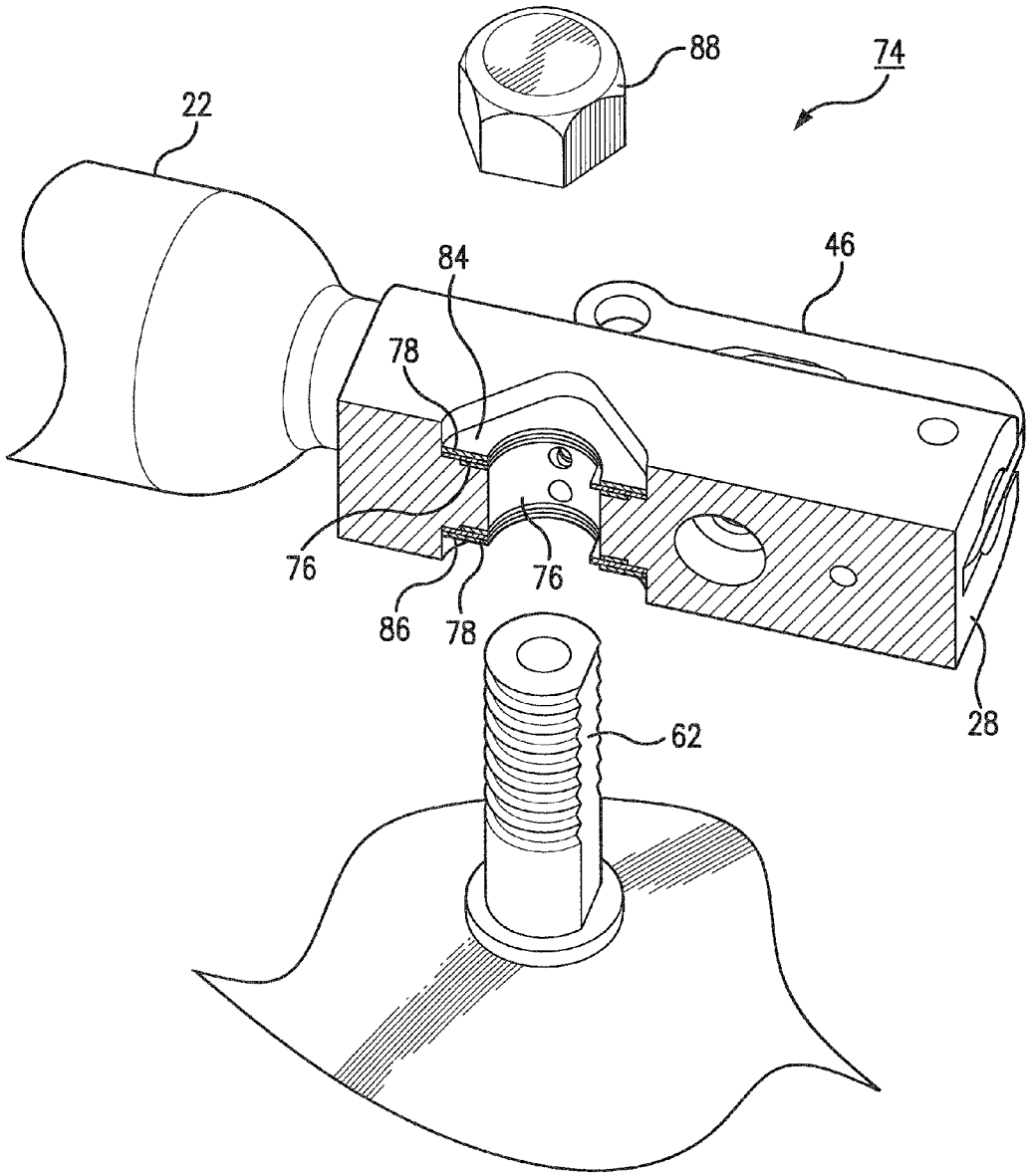
FIG. 6 is a detailed view of the D-shaped keyway assembly of FIG. 5.

FIGS. 5-6 illustrate an alternative embodiment wherein the rotatable D-ring 54 is replaced by a removable D-shaped keyway assembly 74. Keyway assembly 74 comprises a D-shaped fitting 76 and a D-shaped washer 78. The D-shaped fitting 76 is preferably formed from a stainless steel or aluminum. D-shaped washer 78 is preferably formed from a resilient elastomeric material. Both elements of the keyway assembly 74 include a rectangular outer periphery and a D-shaped inner periphery that matches the profile of a standard Schrader valve 62.

Keyway assembly 74 is removably positioned within a corresponding rectangular aperture 82 within end cap 28. Keyway assembly 74 can be inserted into aperture 82 in any of four different orientations. These orientations are positioned at 90° angles to one another. By changing the orientation of keyway assembly 74 within recess, the relative position between the gas inflation device 20 and Schrader valve 62 can be changed. This, in turn, permits device to be reoriented with respect to the article being inflated. FIG. 5 illustrates the internal components of the end cap for use in connection with a $CO_2$ type inflator. However, it is also within the scope of the present invention to use the keyway assembly 74 in connection with a standard automotive inflator as noted above.

FIG. 6 is a cross sectional view of the keyway assembly 74 as it is positioned within recess 82. As noted, the assembly 74 may further include top and bottom washers (84 and 86) as well as an end cap 88. Namely, a resilient top washer 84 is fitted over the D-fitting 76 and D-washer 78. Furthermore, a resilient bottom washer 86 is positioned at the base of the Schrader valve opening. The end of Schrader valve 62 includes a threaded extent that is adapted to be fitted to a threaded end cap 88. A fluid port is included along the length of the valve to permit air flow after cap 88 is secured. By tightening end cap 88 a fluid tight seal is formed at the top and bottom of Schrader valve by way of the bottom washer, D-shaped washer, D-shaped fitting, and top washer. Thus, the annular space around the stem of Schrader valve 62 can become pressurized during inflation.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described,

What is claimed is:

1. A water activated gas release system for use in conjunction with a crewmember worn inflatable article, the system comprising:

a Schrader valve in fluid communication with the inflatable article;

a container having forward and rearward ends, the container storing a volume of an inflation gas, a diaphragm at the forward end of the container, a puncture pin proximate the diaphragm;

a salinity sensor in communication with a primer, the salinity sensor adapted to trigger the primer upon detecting a requisite level of salinity, the primer when triggered piercing the diaphragm to permit the escape of the inflation gas;

an end cap with a cover and a skirt fitted over the forward end of the container, a circular opening formed within the cover, a slot forming a fluid passage between the circular opening and the diaphragm;

a lever pivotally secured to the end cap, the puncture pin connected to a distal end of the lever, whereby the lever can be manually pivoted to puncture the diaphragm and permit the escape of the inflation gas;

a ring rotatably positioned within the circular opening, the ring having a D-shaped internal periphery that is dimensioned to fit over the Schrader valve, a series of openings formed through the periphery of the ring and adapted to be brought into registry with the slot, whereby the orientation of the device can be changed while maintaining a fluid path between the diaphragm and the Schrader valve.

2. A water activated gas release device for use in conjunction with an inflatable article, the inflatable article including a valve stem, the device comprising:

a container for an inflation gas having forward and rearward ends;

an end cap with a cover, an opening formed within the cover, a slot forming a fluid passage between the opening and the container;

a ring rotatably positioned within the opening, the ring having an internal periphery that is dimensioned to fit over the valve stem, a series of openings formed through the periphery of the ring and adapted to be brought into registry with the slot.

3. The device as described in claim 2 further comprising a means for manually rupturing the container to permit the escape of the inflation gas.

4. The device as described in claim 3 wherein the means for manually rupturing the container comprises a puncture pin.

5. The device as described in claim 2 further comprising a means for automatically rupturing the container to permit the escape of the inflation gas.

6. The device as described in claim 5 wherein the means for automatically rupturing the container is a circuit comprising a salinity sensor, a battery, and a primer that are used to actuate the puncture pin.

7. The device as described in claim 2 whereby the orientation of the device can be changed while maintaining a fluid path between the container and the valve stem.

8. The device as described in claim 2 wherein the valve stem is a Schrader valve and the ring includes a "D" shaped interior area.

9. The device as described in claim 2 wherein the container is a $CO_2$ canister.

10. The device as described in claim 2 wherein the opening within the cover is rectangular and further comprising a series of D-shaped fittings that are secured within the rectangular opening and into which the valve stem can be inserted.

11. The device as described in claim 10 wherein one of the D-shaped fittings is an elastomeric washer.

12. The device as described in claim 10 wherein a detent mechanism is used to secure the ring in one of four different angular orientations within the housing.

13. A fitting for a gas release device, the fitting serving to rotatably interconnect a gas release device to a valve stem, the fitting comprising:

an end cap with a cover, an opening formed within the cover, a slot forming a fluid passage between the opening and the gas release device;

a ring rotatably positioned within the opening, the ring having an internal periphery that is dimensioned to fit over the valve stem, a series of openings formed through the periphery of the ring and adapted to be brought into registry with the slot.

14. The fitting as described in claim 13 wherein the series of openings are spaced at 90 degrees from one another.

15. The fitting as described in claim 13 wherein the valve stem is a Schrader valve and wherein the ring has a D-shaped inner periphery.

* * * * *